US006338175B2

(12) United States Patent
Tsimmerman et al.

(10) Patent No.: US 6,338,175 B2
(45) **Date of Patent: *Jan. 15, 2002**

(54) MOVABLE SAFETY TUNNEL FOR USE DURING BRIDGE MAINTENANCE

(75) Inventors: Valery Tsimmerman, Reisterstown; Antonios E. Aikaterinidis, Bel Air, both of MD (US)

(73) Assignees: Orah Constuctive Technologies Incorporated, West Friendship; Alpha Painting & Construction Company, Baltimore, both of MD (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/752,986

(22) Filed: Jan. 2, 2001

Related U.S. Application Data

(63) Continuation of application No. 09/388,818, filed on Sep. 1, 1999, now Pat. No. 6,170,106.

(51) Int. Cl.[7] ..... E01D 19/00; E01D 21/00; E01D 1/00; E04G 3/14; E04G 3/16

(52) U.S. Cl. ..... 14/74; 14/77.1; 14/78; 404/1; 404/6; 105/458; 182/37; 182/36; 182/63.1; 182/141; 182/142

(58) Field of Search ..... 14/74, 77.1, 78; 404/1, 6; 405/132, 141, 145; 105/458; 182/36, 37, 141, 142, 138, 63.1

(56) References Cited

U.S. PATENT DOCUMENTS

| | | | | | |
|---|---|---|---|---|---|
| 2,067,344 | A | * | 1/1937 | Ringe | 182/13 |
| 3,076,522 | A | * | 2/1963 | Goodell | 182/13 |
| 3,885,397 | A | * | 5/1975 | Fujimori | 405/288 |
| 4,211,504 | A | * | 7/1980 | Sivachenko | 405/284 |
| 5,011,710 | A | * | 4/1991 | Harrison | 427/142 |
| 5,014,381 | A | * | 5/1991 | Eddy | 14/17 |
| 5,634,528 | A | * | 6/1997 | Watts et al. | 182/63 |

FOREIGN PATENT DOCUMENTS

EP 0423096 A1 * 10/1990 ..... E01D/19/10

* cited by examiner

*Primary Examiner*—Thomas B. Will
*Assistant Examiner*—Alexandra K. Pechhold
(74) *Attorney, Agent, or Firm*—Leonard Bloom

(57) ABSTRACT

A movable safety tunnel rides on parapets within a bridge. The safety tunnel is locked in place in a respective section of the bridge while maintenance or other operations are performed on that section of the bridge. This allows the traffic to flow through the safety tunnel and along the bridge, and the safety tunnel shields the traffic from any dust or debris. When the maintenance on that respective section of the bridge has been completed, the safety tunnel is unlocked and pushed (and/or pulled) by suitable equipment to the next adjacent section of the bridge; and the safety tunnel is again locked in place as the maintenance is performed. This procedure continues, progressively, along the bridge. In one embodiment, the safety tunnel has a trolley system riding on respective rails constructed on top of the parapets.

7 Claims, 18 Drawing Sheets

MOVABLE SAFETY TUNNEL FOR USE DURING BRIDGE MAINTENANCE

This is a continuation of application Ser. No. 09/388,818, filed Sep. 1, 1999, now U.S. Pat. No. 6,170,106.

FIELD OF THE INVENTION

The present invention relates to a movable shield and containment system for the maintenance of existing bridges and, more particularly, to a "safety tunnel" which is movable with respect to the bridge structure to facilitate traffic flow along the roadway of the bridge (and/or under the bridge) while protecting the traffic flow from falling debris during the maintenance work on the bridge.

BACKGROUND OF THE INVENTION

Existing bridges require substantial maintenance. The maintenance is required at least periodically, if not continuously. For example, it is often necessary to remove the paint (such as a lead-based paint) from the steel structure of a bridge prior to applying a new coating thereto. To remove the paint, conventional sand-blasting or shot-blasting equipment is used. Suitable available measures are taken (as hereinafter discussed) to prevent the debris from falling onto the roadway, or into any water below the bridge, or otherwise polluting the environment.

At the same time, it is also very desirable to facilitate the continuous traffic flow along the roadway, while the maintenance is being performed, and thus avoid a complete shutdown of the traffic flow. While the traffic flow is primarily vehicular or railway traffic, it is also desirable to maintain any pedestrian traffic as well as facilitate access for the maintenance crews. By maintenance, it is understood that any repair or construction on the bridge is contemplated herein.

To maintain the traffic flow while the maintenance is being performed, the prior art has resorted to the use of a shield and containment structure (commonly referred to as a "traffic shield") constructed within or under the bridge, along a given length thereof, and above the deck or roadway of the bridge.

This conventional traffic shield, together with the roadway, provides a complete enclosure for the traffic flow (which may be vehicular, railway, pedestrian or some combination thereof). Within the traffic shield (or thereunder) the traffic is protected against any falling debris—such as paint chips from the bridge, the materials of shot blasting or sand blasting, and any tools, components or structural elements accidentally dropped by the maintenance workers. By the same token, the workers are protected against the vehicular or rail traffic. As a result, a complete shut-down of the bridge is avoided, and the traffic flow is substantially unimpeded while the maintenance is being performed.

However, when the maintenance has been completed on a given length or section of the bridge, the traffic may be halted for a substantial period of time sufficient to enable the workers to completely dismantle the traffic shield, move its individual components to the next successive section of the bridge, and then re-assemble the traffic shield therein. This is time-consuming, hence expensive, and causes a substantial traffic problem; and a need exists for a more efficient solution to this long-standing problem.

BRIEF SUMMARY OF THE INVENTION

Accordingly, it is the primary object of the present invention to alleviate the disadvantages and deficiencies of the prior art by providing a movable safety tunnel within the bridge, thereby resulting in a substantial cost-savings and, concurrently, holding the inconvenience to the motorists to an absolute minimum.

The present invention finds particularly utility for use in connection with a bridge having a roadway for vehicular and/or pedestrian traffic, wherein maintenance is being performed on the bridge, and wherein a safety tunnel is constructed within a respective longitudinal section of the bridge. Accordingly, the traffic flows on the roadway of the bridge substantially uninterrupted while the maintenance is being performed on the respective longitudinal section of the bridge. More specifically, the traffic on the roadway of the bridge is protected against falling debris, such as paint particles, materials for shot blasting or sandblasting, tools, components and the like. At the same time, the workers performing the maintenance are shielded from the traffic flow. Once the maintenance on the respective longitudinal section of the bridge is completed, the traffic shield is normally dismantled and thereafter reconstructed on a next adjacent longitudinal section of the bridge.

In the improvement of the present invention, the traffic shield comprises a safety tunnel which is movable along the length of the bridge.

As a result, the necessity for repeatedly dismantling and reconstructing a conventional traffic shield is eliminated (as the maintenance on the bridge progresses along the length of the bridge).

For example, and in comparison to the prior art, if the bridge is sixteen hundred (1600) feet long, and if the conventional traffic shield is one hundred (100) feet long, it will have to be assembled, disassembled and re-assembled approximately sixteen (16) times. Thus is time-consuming and expensive and a distinct inconvenience, repeatedly, for the vehicular traffic on the bridge. With the present invention, however, the safety tunnel may be rolled from place to place along the bridge without requiring the safety tunnel to be taken apart.

In a preferred embodiment of the present invention, rails are constructed on top of the respective parapets running along the respective sides of the deck or roadway of the bridge, and the movable safety tunnel has a trolley system riding on the rails.

The trolley system is locked to a respective longitudinal section of the rails as the maintenance is being performed on a corresponding respective length of the bridge; and the trolley system is unlocked from the respective longitudinal section of the rails to enable the safety tunnel to be moved to the next adjacent section of the bridge on which the maintenance is to be performed. The safety tunnel is pushed and/or pulled by a tow truck (or other suitable piece of equipment) to the next adjacent section of the bridge.

Preferably, the trolley system comprises a plurality of respective spaced-apart trolley assemblies.

In the preferred embodiment, the safety tunnel includes an inverted U-shaped structure having a roof assembly joined to respective sides depending therefrom. These respective sides have lower portions carried by the plurality of trolley assemblies riding on the respective rails.

These and other objects of the present invention will become apparent from a reading of the following specification taken in conjunction with the enclosed drawings.

BRIEF DESCRIPTION OF THE DRAWINGS

FIG. 1 is a schematic (pictorial) side elevation of a typical bridge using a stationary traffic shield—heretofore habitually resorted to in the prior art—to facilitate vehicular traffic flow during maintenance operations on a selected section along the length of the bridge.

FIG. 2 is a cross-sectional view thereof, taken along the lines 2—2 of FIG. 1 and drawn to an enlarged scale.

FIG. 3 corresponds substantially to FIG. 1, but shows the prior art stationary traffic shield being dismantled following completion of the maintenance on the respective lengthwise section of the bridge.

FIG. 4 corresponds substantially to FIG. 3, but shows the traffic shield being re-assembled on the next adjacent lengthwise section of the bridge.

FIG. 5 corresponds substantially to FIG. 4, but shows the traffic shield re-assembled and fixed in place to again resume flow of the vehicular traffic.

FIG. 6 corresponds substantially to FIG. 1; however, the traffic shield is not fixed or stationary but, rather, constitutes a movable safety tunnel that may be moved along the length of the bridge as progressive sections of the bridge are being worked on and maintained.

FIG. 7 is a cross-sectional view thereof taken along the lines 7—7 of FIG. 6, drawn to an enlarged scale and corresponding substantially to FIG. 2, and showing the movable safety tunnel having a trolley system riding on rails replaceably mounted on top of the respective parapets at the sides of the roadway—the trolley system being selectively locked and unlocked on the rails—such that the safety tunnel is movable into the next adjacent section of the bridge.

FIG. 8 corresponds substantially to FIG. 6, but shows the safety tunnel being moved to the next adjacent section of the bridge.

FIG. 9 corresponds substantially to FIG. 8 but shows the safety tunnel locked in place on the next adjacent section of the bridge, thereby enabling the traffic flow to resume as the maintenance is performed on the next adjacent section of the bridge.

DESCRIPTION OF THE PREFERRED EMBODIMENTS

With reference to FIGS. 1–5, the disadvantages and deficiencies of the prior art will become readily apparent.

Figure 1:
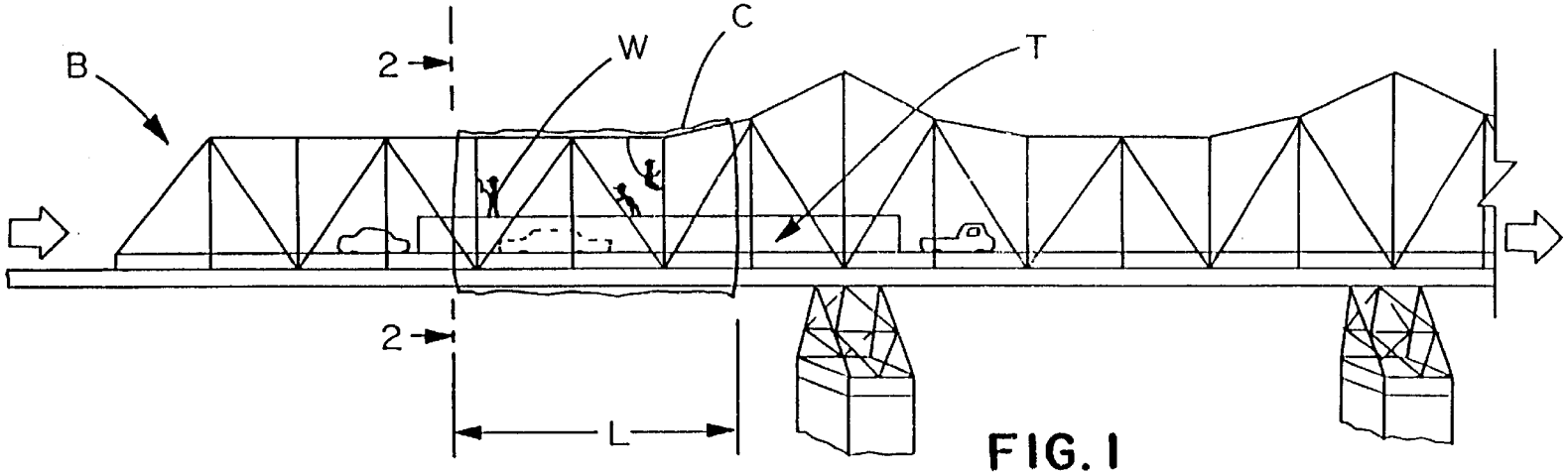
FIG. 1 PRIOR ART
FIGS. 1–5 illustrate, schematically, the teachings of the prior art and the disadvantages and deficiencies therein.

In FIG. 1, the workers W are performing maintenance, repair and/or construction operations on a given length L of a bridge B. While this work is being performed, the traffic flow of the vehicles is accommodated by a conventional traffic shield T.

Figure 2:
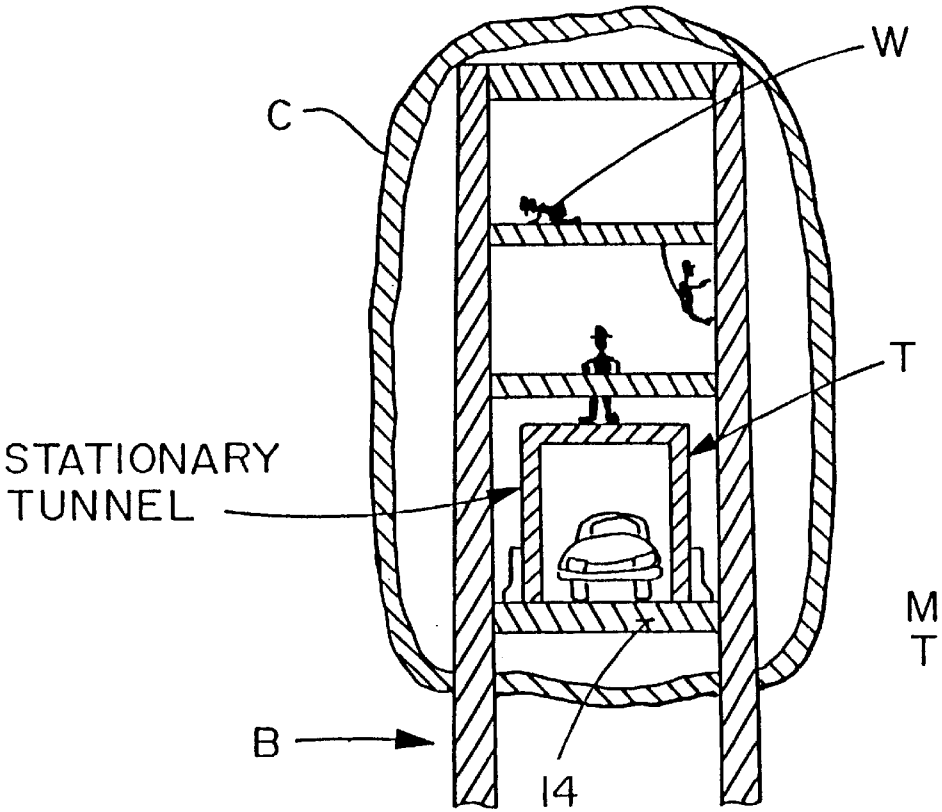
FIG. 2 PRIOR ART

As shown in FIG. 2, the traffic shield T is an inverted U-shaped structure which cooperates with the deck or roadway 14 of the bridge B.

In the prior art, the respective length L of the bridge B (being worked on) is enclosed by a suitable tarp or cover C. This cover C is shown broken away in FIGS. 1 and 5, and is omitted in FIG. 4 for ease of illustration. The purpose of the cover C is to assure that the paint chips, the sand for sand-blasting or the steel balls used for shot-blasting, and any other dust and debris that is generated will be wholly confined within the cover C. A truck-mounted vacuum cleaner (not shown) continually removes all of the dust and debris; and where shot-blasting equipment is used, filters out the steel balls for subsequent reuse. Between the cover C and the bridge B, suitable catwalks and/or scaffolding (also not shown) are installed for facilitating the maintenance work and ready access for the workers. Again, all of this is well-known in the prior art; hence need not be detailed herein.

Figure 3:
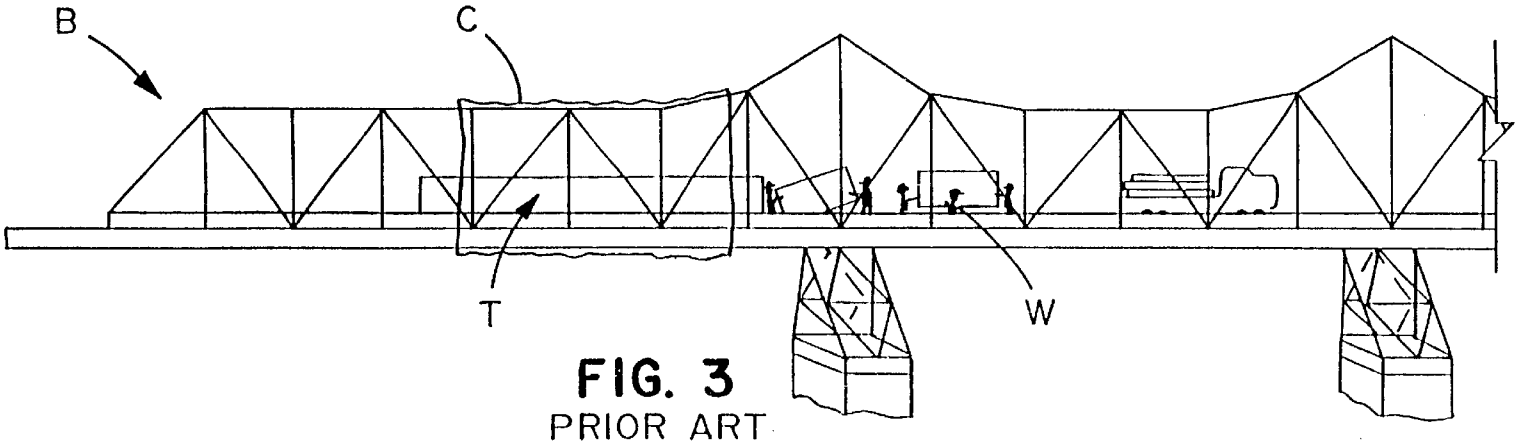
FIG. 3 PRIOR ART
Figure 7:
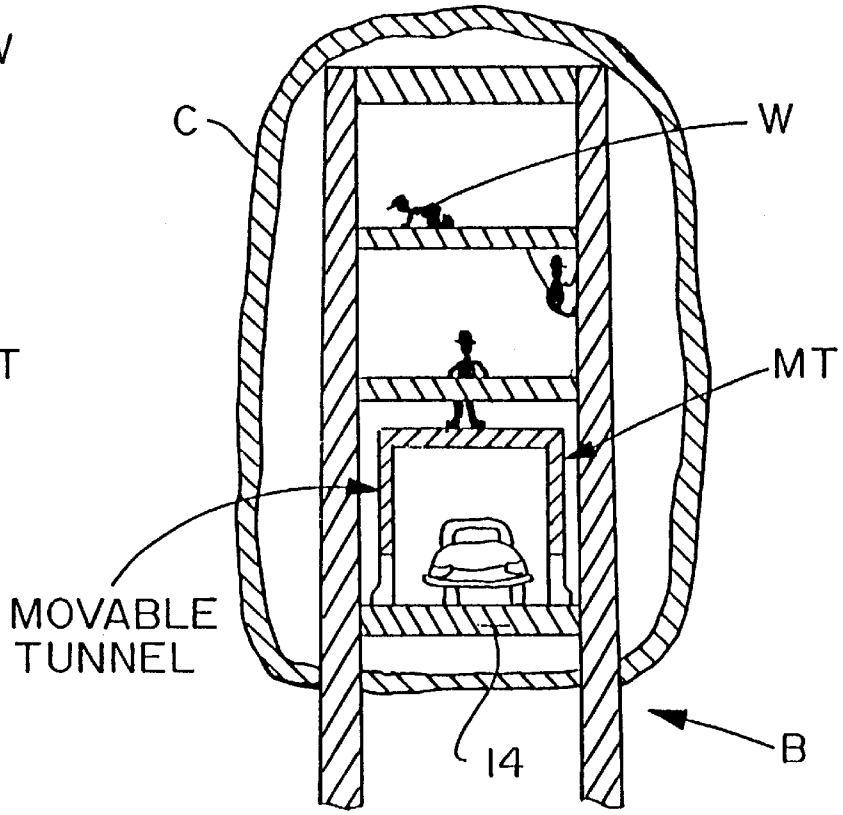
FIGS. 6–9 illustrate, schematically, the improvement of the present invention and its features and advantages.
Figure 4:
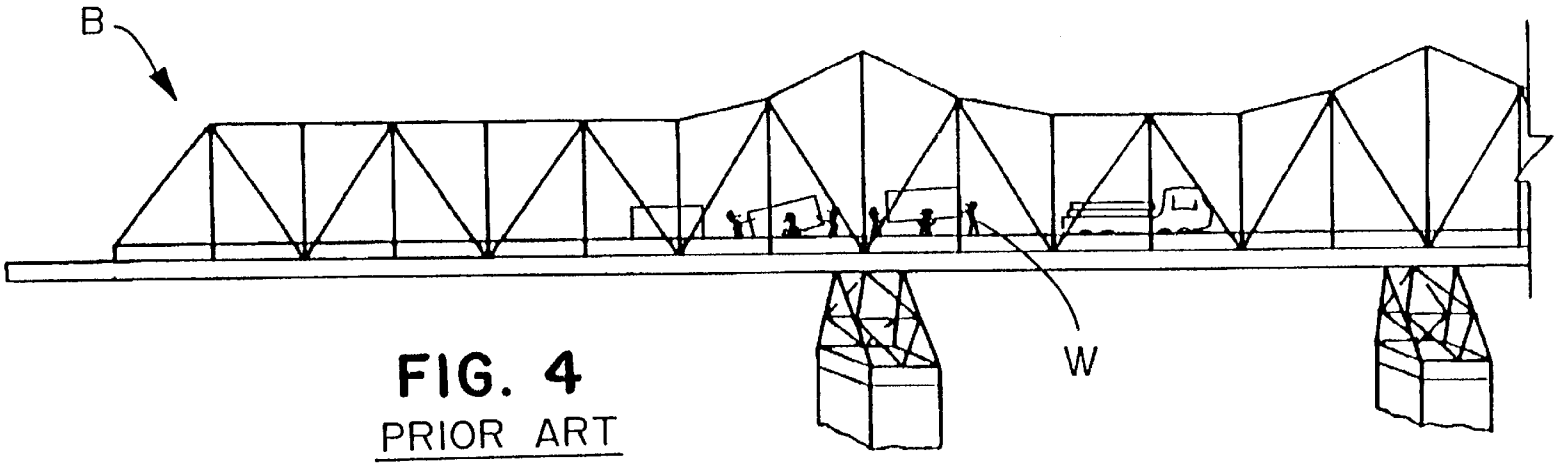
FIG. 4 PRIOR ART
Figure 5:
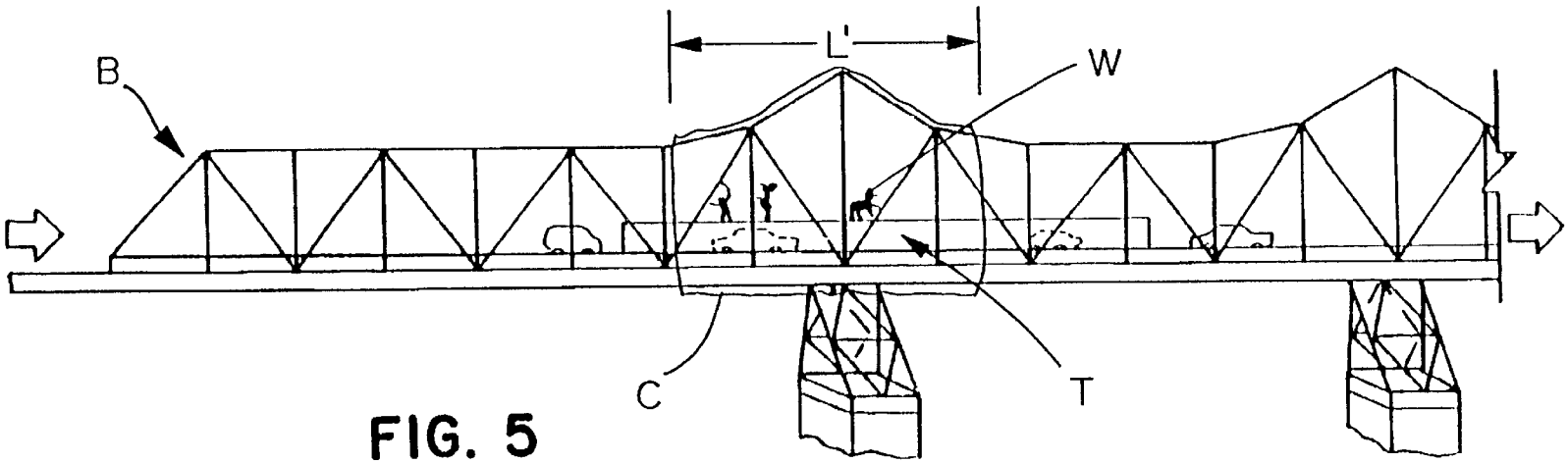
FIG. 5 PRIOR ART
Figure 6:
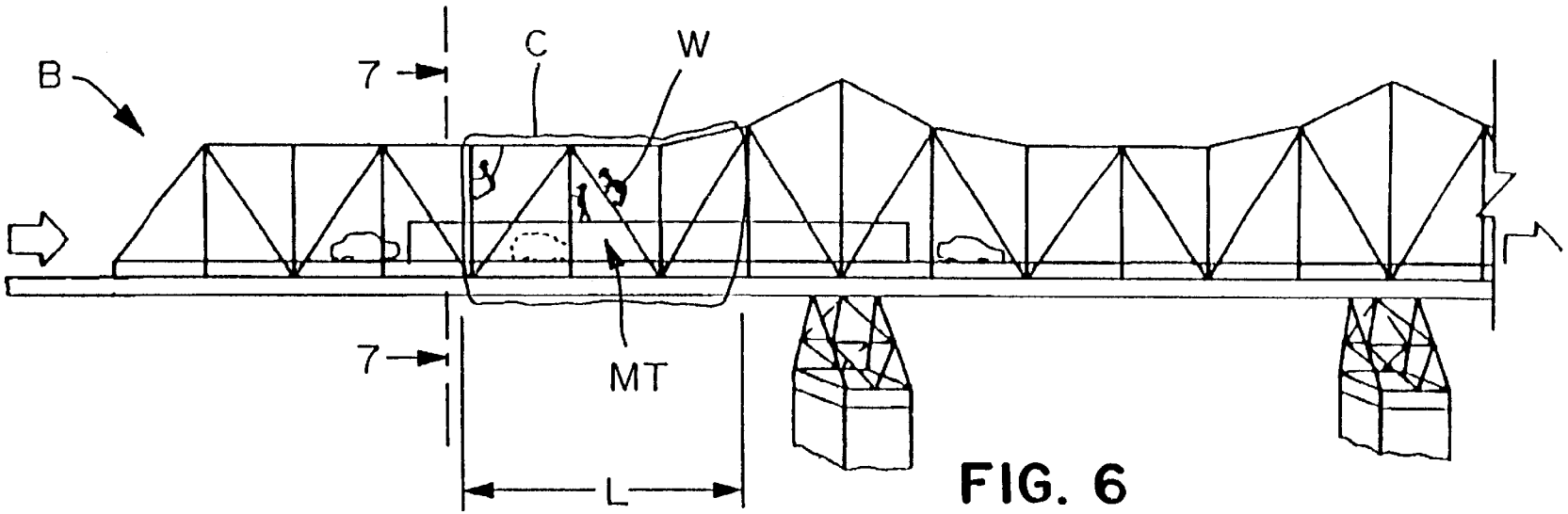

Of significance, however, and as shown schematically in FIGS. 3 and 4, once the maintenance work on the respective length L of the bridge B has been completed, the tunnel T must be completely dismantled or disassembled, taken to the next adjacent length L' of the bridge B, and re-assembled therein as shown in FIG. 5 to resume the normal traffic flow. The tunnel T, once assembled and installed within the length L (or L') of the bridge B, is stationary and fixed in place. It is not readily movable. Not only is the traffic flow interrupted for a substantial time period, but excessive construction costs are incurred.

With reference to FIGS. 6–9, the improved tunnel MT of the present invention is movable, not stationary, and this is the key feature of the invention.

The movable tunnel MT may be pre-fabricated in sections, taken to the bridge B and installed with use of a crane or other suitable equipment. Final assembly of the tunnel MT may take place on the bridge B. In a preferred embodiment, the tunnel MT may have length of around 200 feet.

Figure 8:
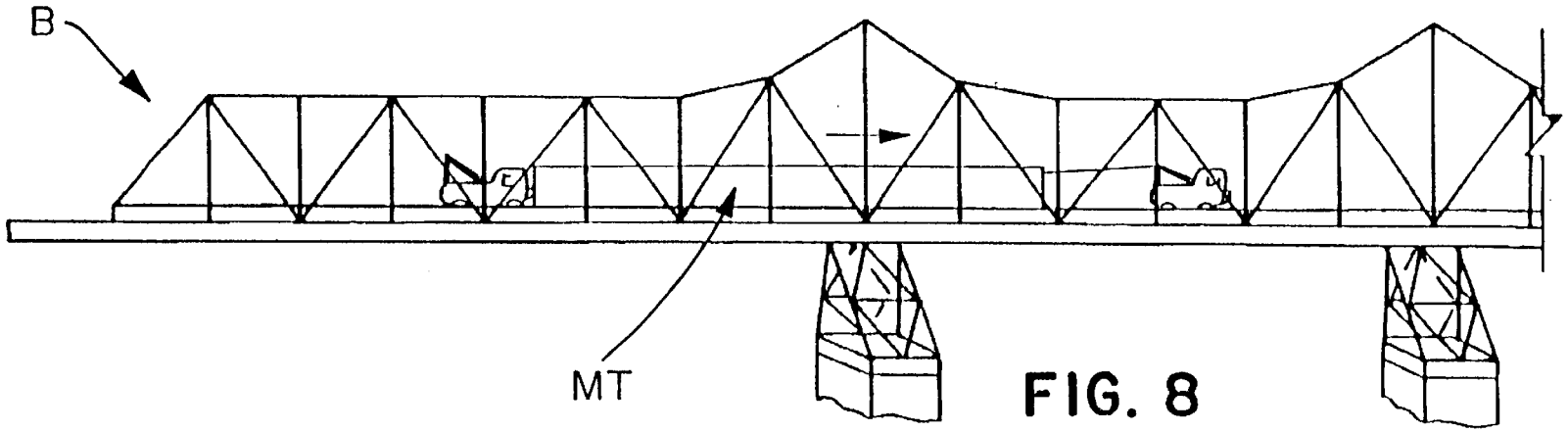
Figure 9:
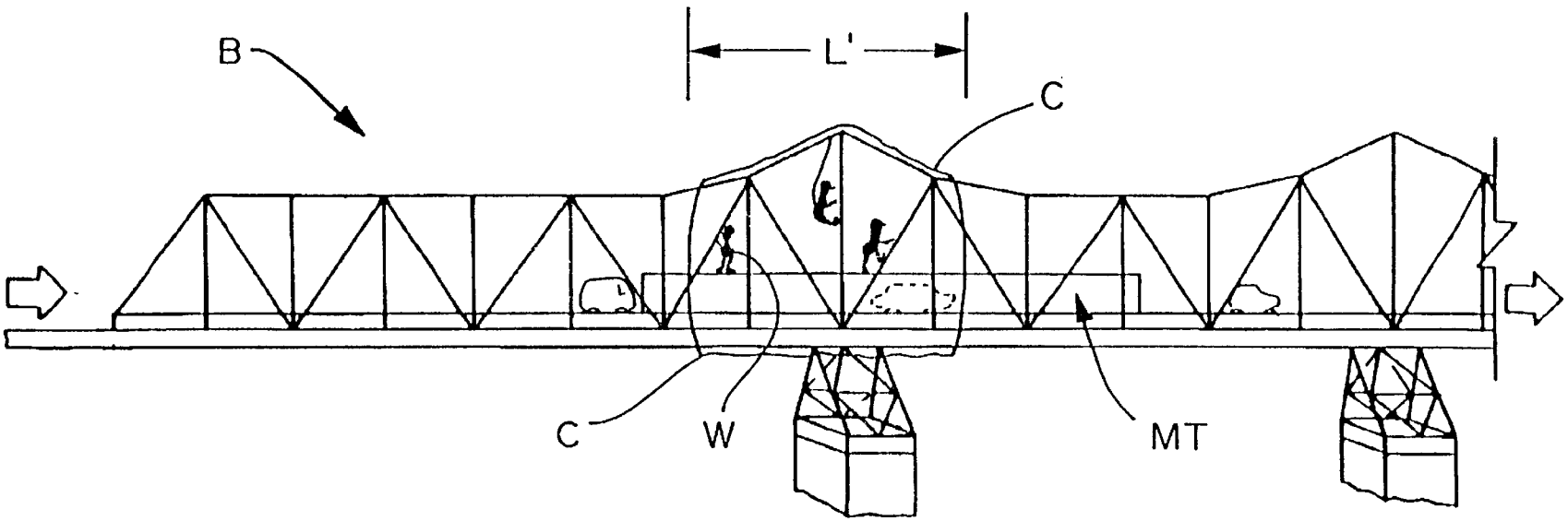

The tunnel MT is movable along the entire length of the bridge (in progressive increments) as the maintenance operations are performed. For this purpose, the tunnel MT has a trolley system (hereinafter described in detail) which rides on specially-built rails on top of parapets on each side of the roadway. When a particular section of the bridge B is to be worked on, the trolley system is locked against movement on the rails; and when the work on that particular section of the bridge B has been completed, the locking mechanism is released, and the entire tunnel MT (being movable as shown in FIG. 8) is pushed or pulled by a fork-lift truck (or other suitable equipment) into the next adjacent, and possibly overlapping, position along the bridge B. Thereafter, and as shown in FIG. 9, the trolley system is again locked against movement of the tunnel MT along the length of the bridge B, so that the maintenance work can be performed on the next section L' of the bridge B; and the process is repeated until the work on the entire bridge B has been completed.

The movable tunnel MT is, of course, moved in the direction in which the maintenance is being performed on the bridge B.

Figure 10:
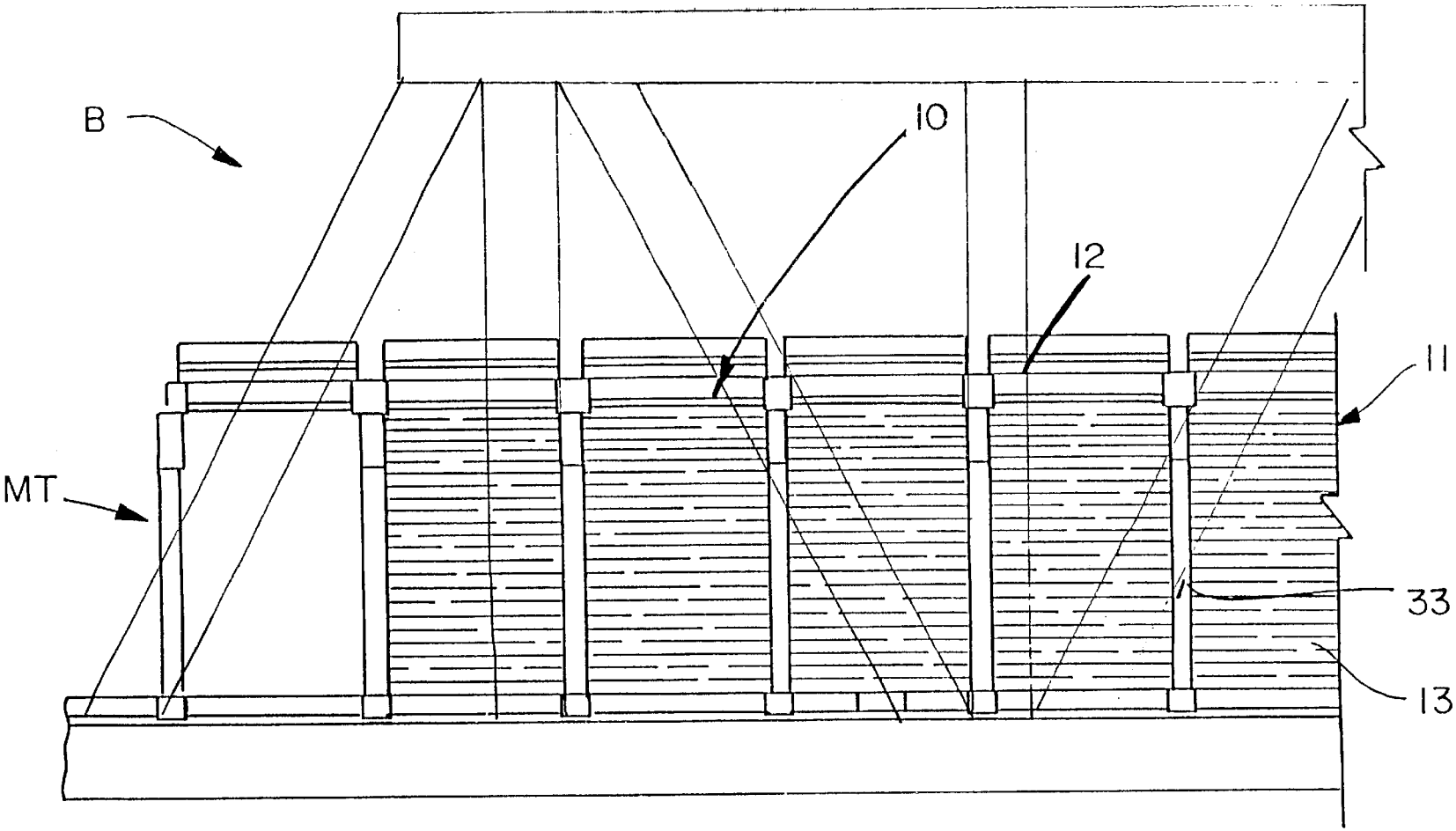
FIG. 10 is a side elevation of the movable tunnel MT, the bridge being shown schematically.
Figure 11:
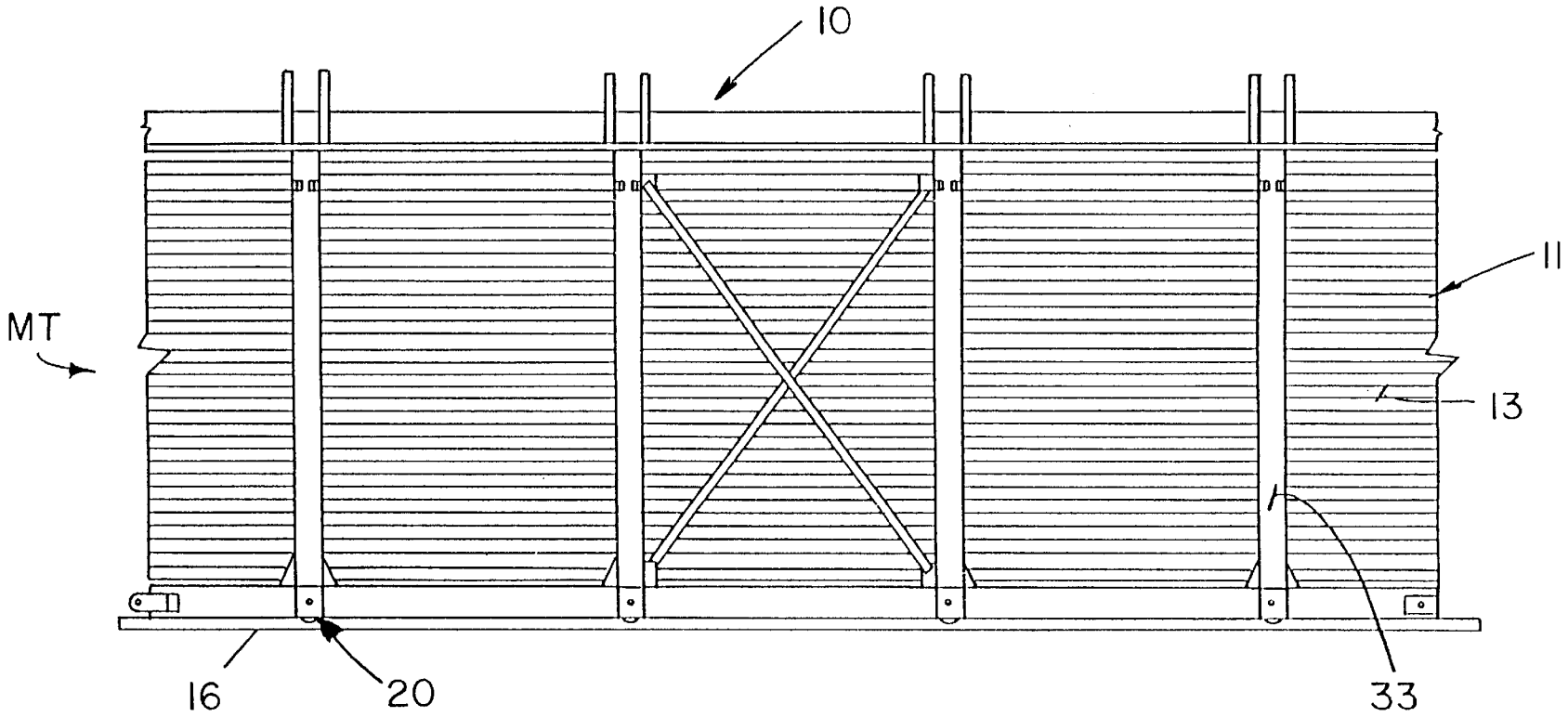
FIG. 11 is a portion of FIG. 10, drawn to an enlarged scale, and showing the construction of the sides of the movable tunnel.
Figure 12:
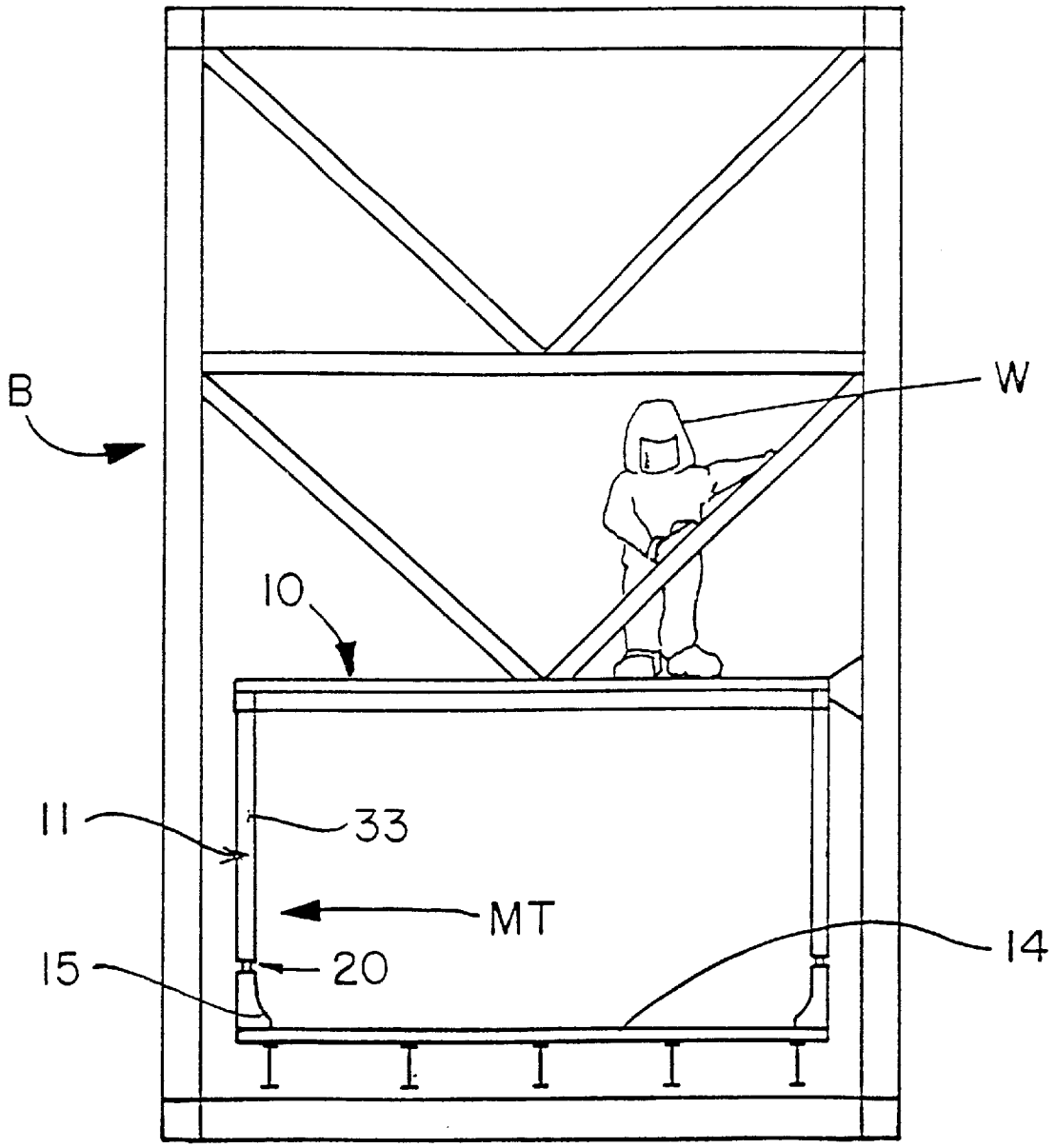
FIG. 12 is an end view of the movable tunnel which cooperates with the roadway of the bridge, the remainder of the bridge being omitted for ease of illustration.
Figure 13:
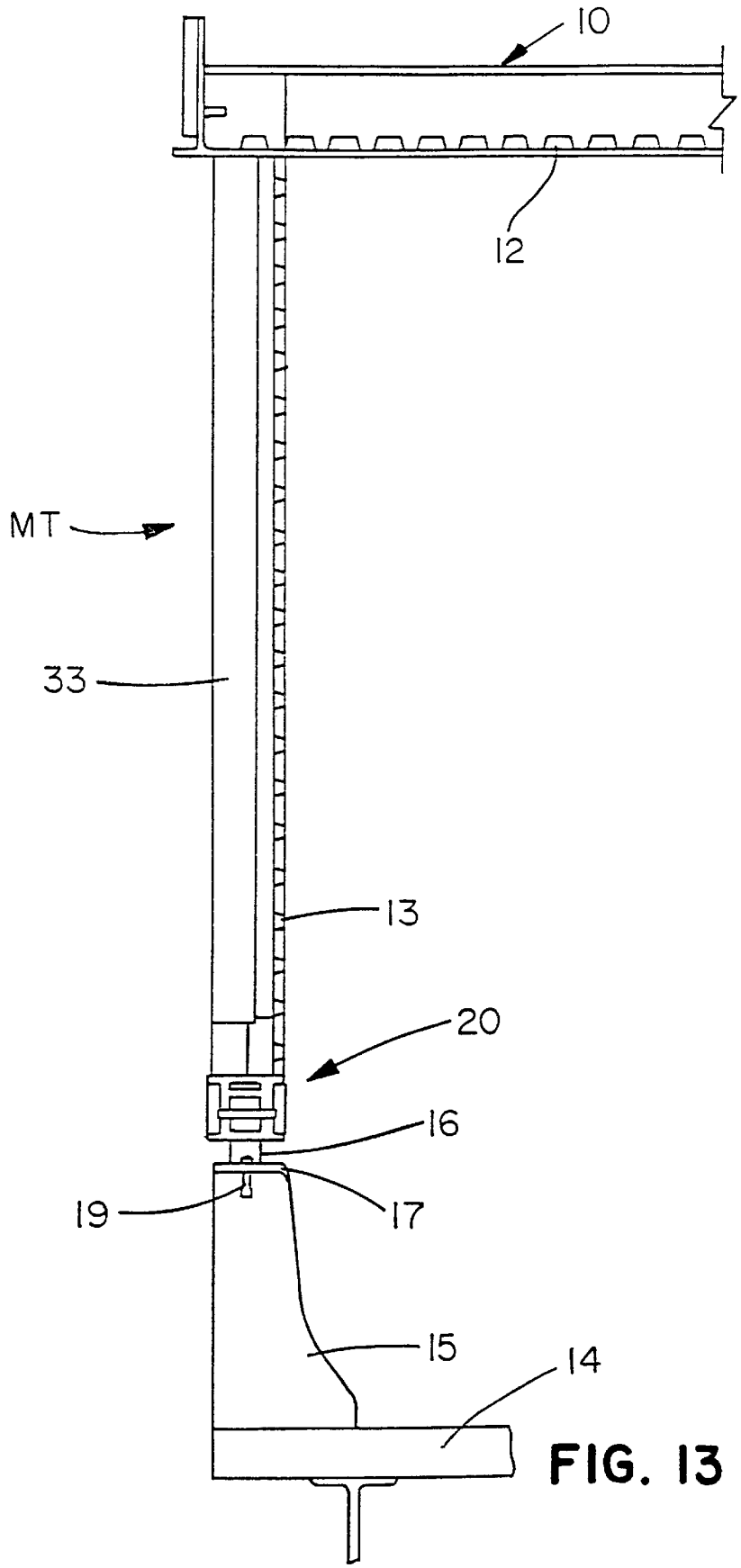
FIG. 13 is a portion of FIG. 12, drawn to an enlarged scale, and showing one of the trolley assemblies riding on a rail mounted on top of one of the parapets at each side of the roadway of the bridge.
Figure 14:
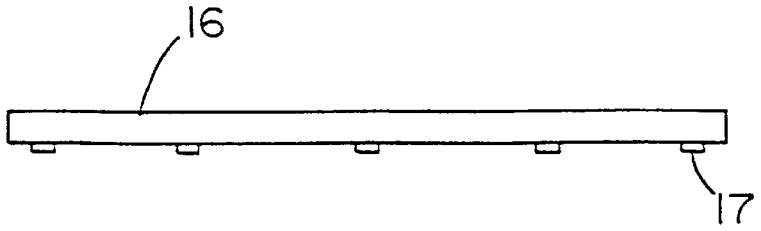
FIG. 14 is an elevational view of a portion of one of the rails.
Figure 15:
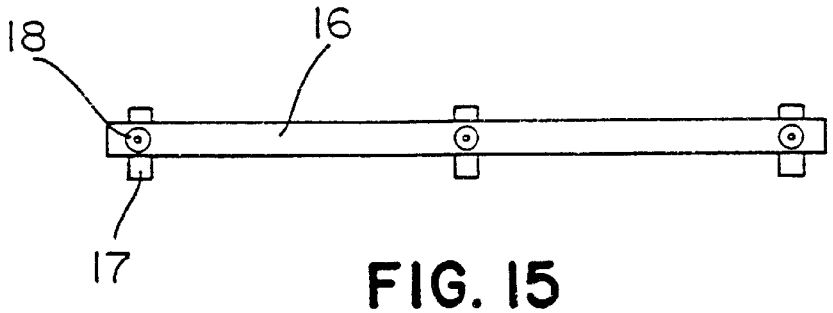
FIG. 15 is a top plan view thereof.
Figure 16:
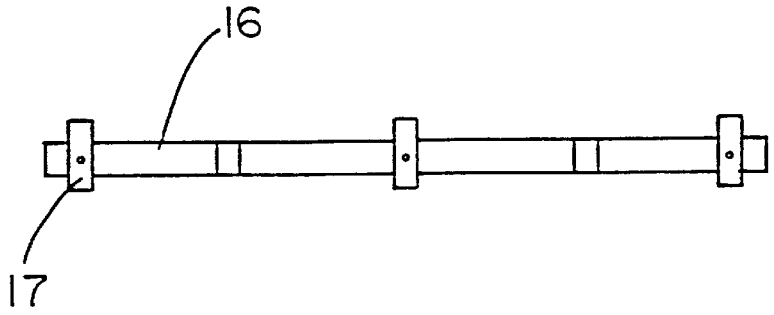
FIG. 16 is a bottom view thereof.
Figure 17:
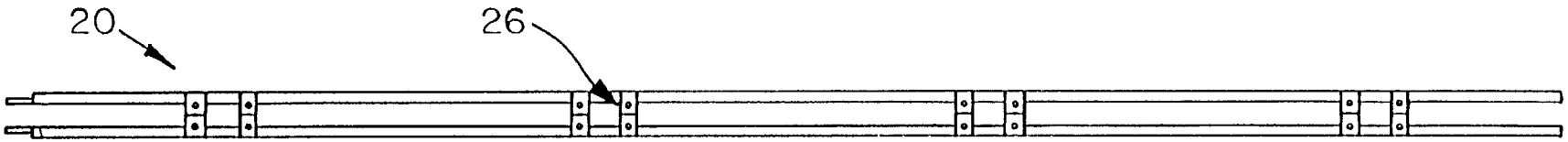
FIG. 17 is a plan view of one of the trolley assemblies within the overall trolley system.
Figure 18:
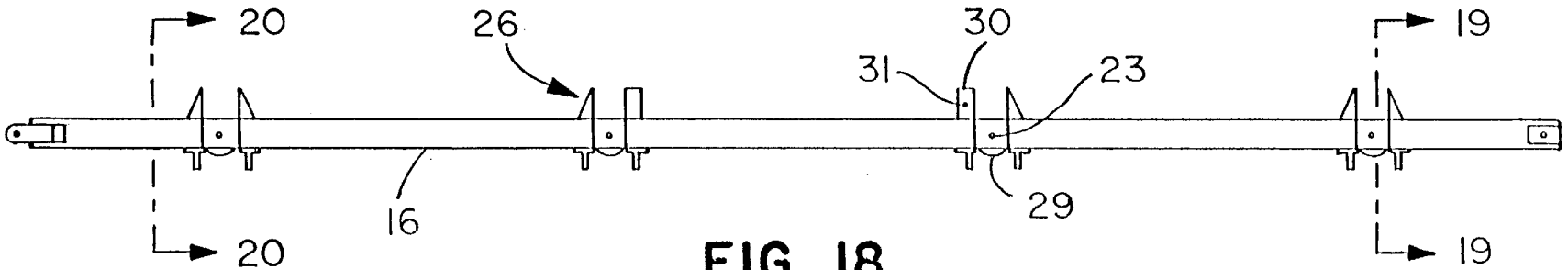
FIG. 18 is an elevational view thereof.

With reference to FIGS. 10–12, the movable tunnel MT is an inverted U-shaped structure including a roof assembly 10 and a pair of parallel side wall assemblies 11 depending therefrom. The roof assembly 10 includes a plurality of individual roof panels 12 connected to respective columns (hereinafter described) and each side assembly 11 includes a plurality of individual side panels 13 connected to respective columns (hereinafter described) thus providing a modular design for construction of the complete movable tunnel MT. Preferably, the roof panels 12 and the side panels 13 are corrugated steel panels, as shown, but it will be understood by those skilled in the art that any suitable panel, such as marine plywood, could be used if desired.

It will also be understood that the movable tunnel MT cooperates with an existing deck or roadway 14 of the bridge B to provide a complete enclosure for the traffic flow.

With reference to FIGS. 12–21, the bridge roadway 14 has respective barrier walls or parapets 15 at each side thereof, and a rail 16 is secured to the top of each parapet 15. Each rail 16 is a closed tube (or box) which, in a preferred embodiment, is 4×4×¼ inches thick. Spaced-apart transverse flanges 17 are welded to the bottom of each rail 16, and the flanges 17 extend laterally from the respective sides of the rail 16, thereby assuring lateral stability of the rail 16 on the parapet 15. These flanges 17 are spaced approximately four feet apart along the length of the rail 16. A 13/16 inch hole is drilled in each flange 17 (and in each bottom wall of the rail 16) along the center line of the rail 16. A 3¼ inch access hole 18 is drilled in the top of the rail 16 along the center line of the respective transverse flange 17. A suitable concrete anchor bolt 19 passes through each access hole 18 and anchors the rail 16 to the parapet 15.

Figure 20:
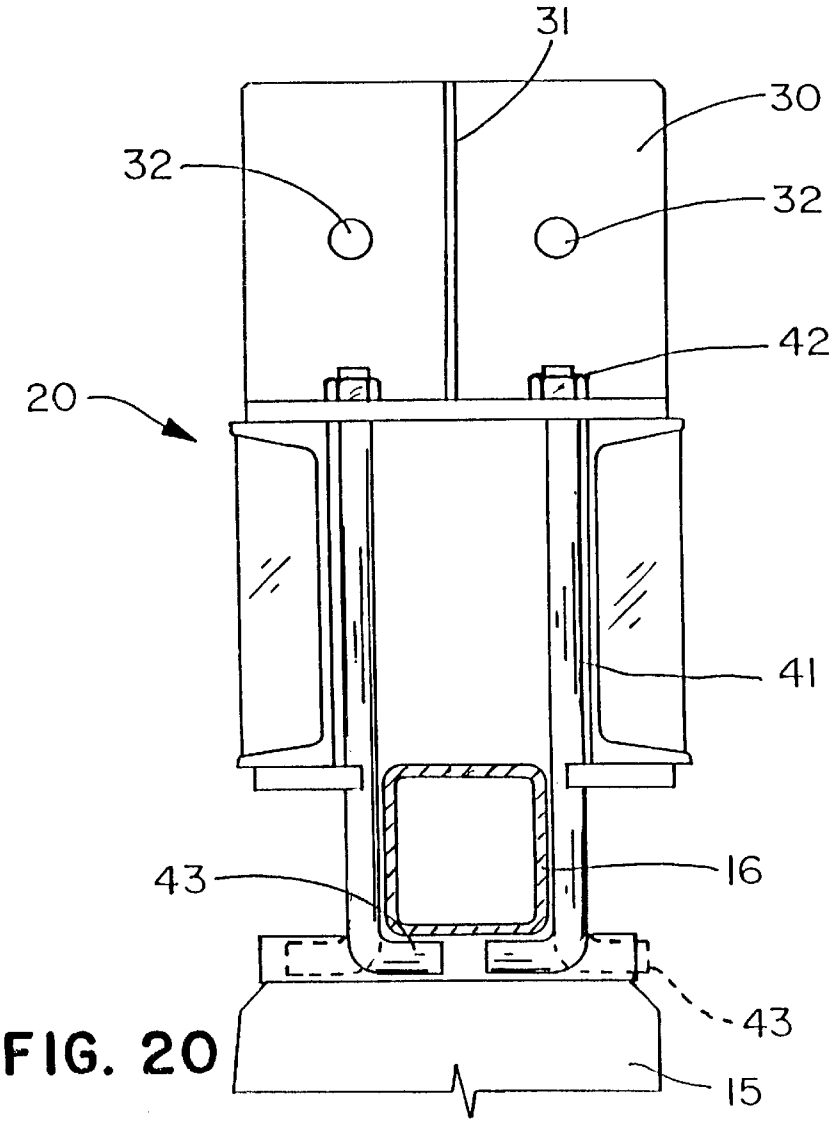
FIG. 20 is a further cross-sectional view thereof, taken along the lines 20—20 of FIG. 18 and drawn to an enlarged scale, and showing the J-bolts of the assembly in a locked position on the rail (the broken lines indicating the unlocked portion).
Figure 19:
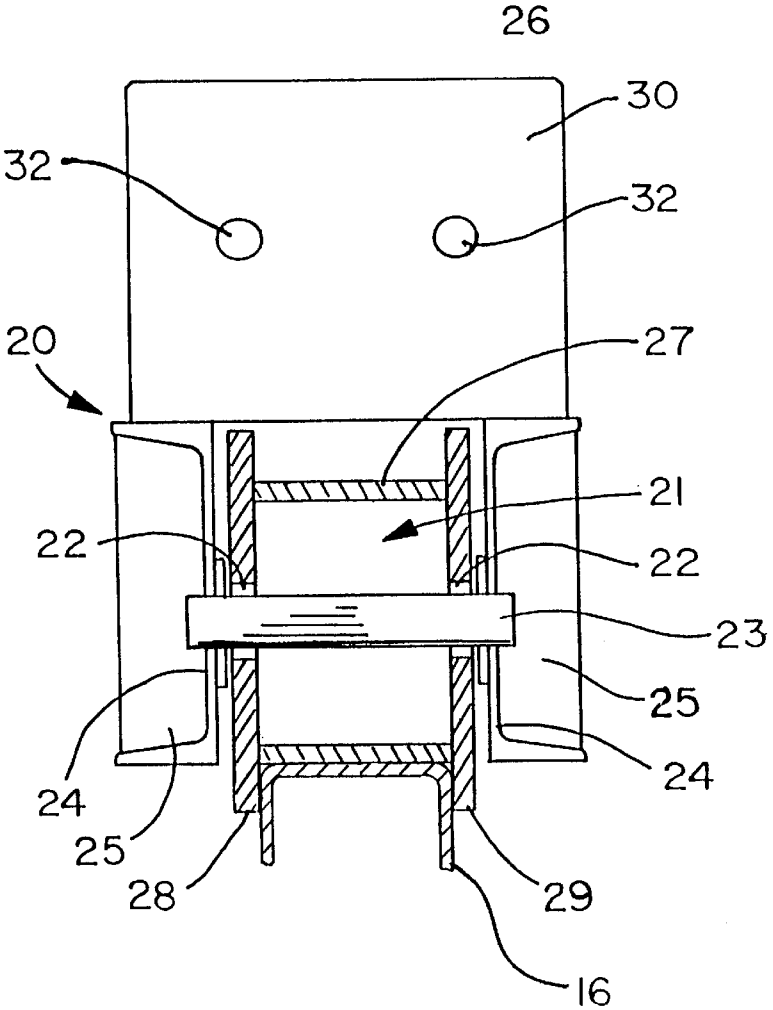
FIG. 19 is a cross-sectional view thereof, taken along the lines 19—19 of FIG. 18 and drawn to an enlarged scale, and showing one of the trolley assemblies.
Figure 23:
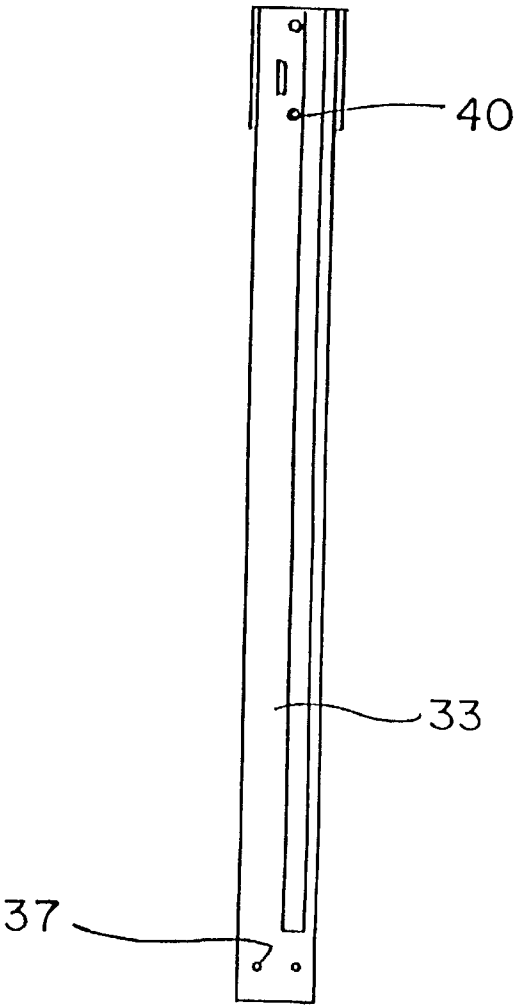
FIG. 23 is a side elevational view of the column of FIG. 22.
Figure 22:
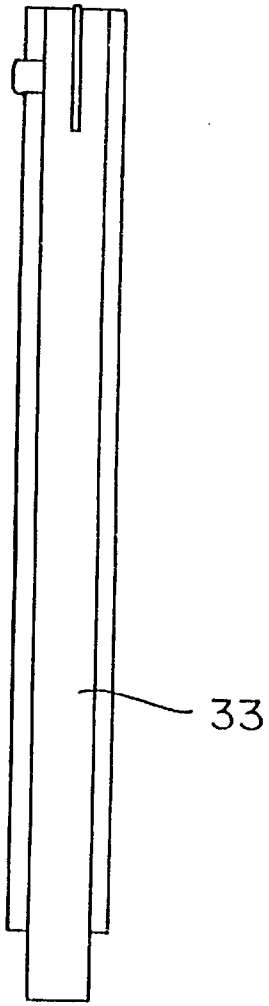
FIG. 22 is a front elevational view of one of the columns, the lower portion of which is secured to the respective upstanding gusset plates of the trolley assembly.
Figure 21:
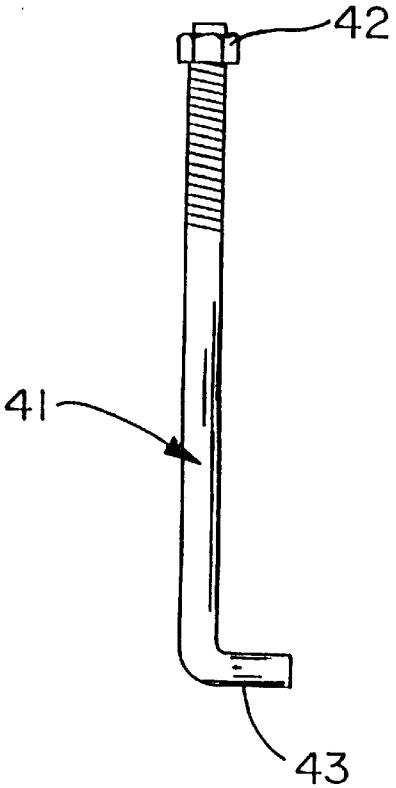
FIG. 21 is an elevational view of one of the J-bolts.
Figure 24:
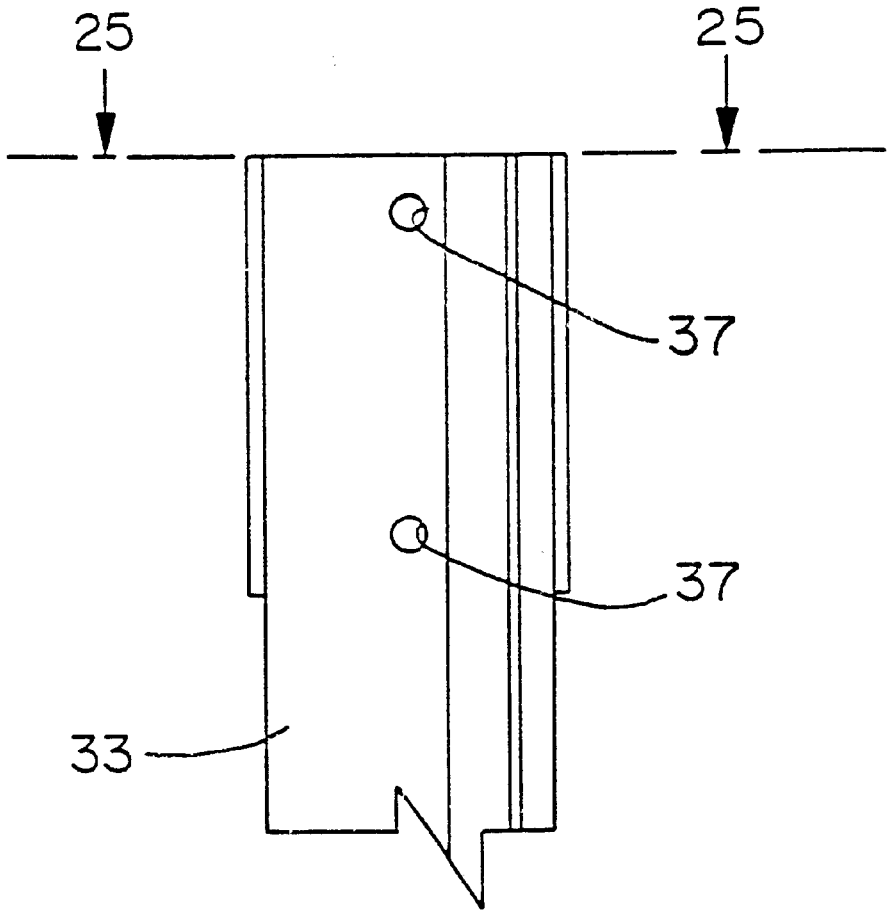
FIG. 24 is an enlarged portion of the upper portion of the column shown in FIG. 23.
Figure 25:
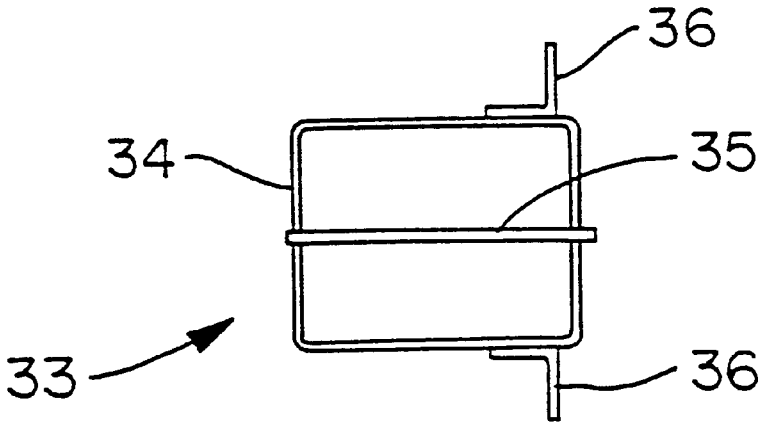
FIG. 25 is a top plan view thereof, taken along the lines 25—25 of FIG. 24.

A trolley assembly 20 rides on each rail 16 (as shown more clearly in FIG. 20). This trolley assembly 20 has a wheel assembly 21 (see FIG. 19) rotatably journaled in sintered oil-impregnated bronze bearings 22 on a central axle or pin 23. These bearings 22 are more desirable than ball-bearings for a grit-laden or shot-laden environment. The respective ends of the pin 23 are secured in a pair of downwardly-projecting spaced-apart channels 24 provided with stiffeners 25. These channels 24 are part of a gusset assembly 26. A plurality of gusset assemblies 26 are provided, being spaced approximately eight feet apart along the length of the trolley assembly 20.

The wheel assembly 21, preferably, consists of a section of a 6⅝ inch pipe 27 cut to a length of 4½ inches and welded between a pair of circular side plates 28 and 29, respectively. The diameter of these circular side plates 28, 29 extends beyond the 6⅝ inch O.D. of the pipe 27, such that the radially-extending portions of the circular side plates 28, 29 straddle the four-inch closed-channel rail 16, thereby providing lateral stability of the trolley assembly 20 on the rail 16 (even if high winds are encountered).

Each gusset assembly 26 has a pair of spaced-apart upwardly-extending gusset plates 30, and each of the gusset plates 30 is provided with a central transverse stiffener 31. Each gusset plate 30 further has a pair of spaced-apart 15/16 inch holes 32, one on each side of the stiffener 31.

A plurality of columns 33 are provided. Each column 33 comprises a rectangular tube 34 that is split on top and welded to a central plate 35. A pair of angles 36 depend from the lower end of the column 33, and the lower portion of each column 33 has a pair of spaced-apart 15/16 inch holes 37. These holes 37 on each column 33 align with the holes 32 on the gusset plates 30, thereby facilitating the bolting of the column 33 to the gusset assemblies 26 (and hence to the trolley assembly 20 which rides on the rail 16).

The roof assembly 10 is adjustably mounted to the top portions of the respective columns 33. The roof assembly 10 has a plurality of depending members 38 telescoped within the columns 33, and each member 38 has a plurality of vertically spaced-apart holes 39 aligned with corresponding holes 40 within the top portions of the respective column 33 for securing the members 38 (and hence the roof assembly 10) to the columns 33. The roof assembly 10 consists of a plurality of corrugated horizontal panels 12, and the roof assembly 10 is raised or lowered on the columns 33 by suitable hydraulic jacks (not shown). This allows the roof assembly 10 to be lowered to clear the structural elements of the bridge B while rolling the movable tunnel MT into its next position along the bridge B. Once adjusted vertically, a drift pin (not shown) is inserted between the aligned holes 39 and 40, respectively.

The trolley assembly 20 is locked against the rails 16, so that the movable tunnel MT does not move while the work is being performed on the particular portion of the bridge B. More specifically, each gusset assembly 26 has a pair of J-bolts 41 carrying respective nuts 42. Each J-bolt 41 may be loosened and then rotated approximately 180° on its axis (see FIG. 20) such that a right-angularly bent portion 43 of each J-bolt 41 is received between the bottom of each rail 16 and its respective parapet 15. When the respective nuts 42 are tightened, the J-bolts 41 are secured against the rail 16 and the trolley assemblies 20 (and hence the movable tunnel MT) are locked against longitudinal movement along the bridge B.

Suitable side panels 13, such as corrugated sheeting or marine plywood panels, are secured between the respective columns 33, thereby completing the movable tunnel MT. This assures that no dust particles, shot blasting or sand blasting material or debris will enter into the movable tunnel MT, thereby protecting the traffic flow therein.

Figure 26:
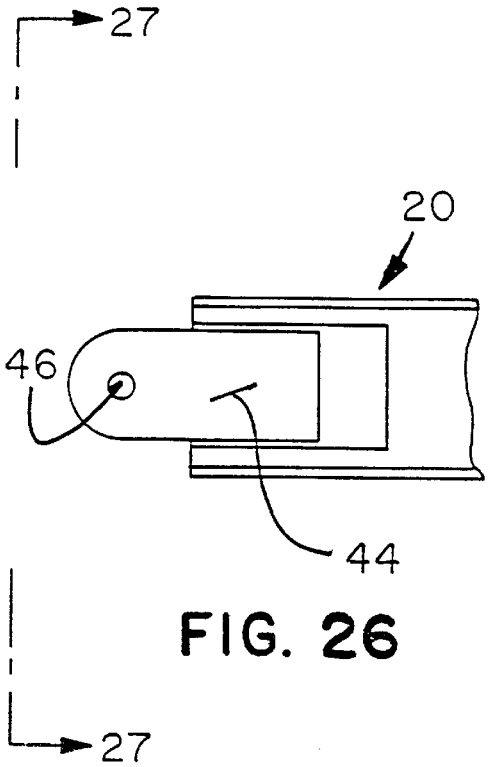
FIG. 26 is a side elevation of an end portion of the trolley assembly of FIG. 18, drawn to an enlarged scale and detailed.
Figure 27:
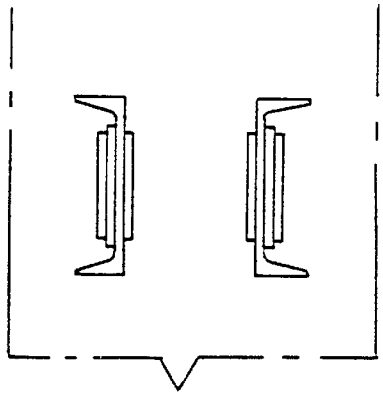
FIG. 27 is an end view thereof, taken along the lines 27—27 of FIG. 26.
Figure 28:
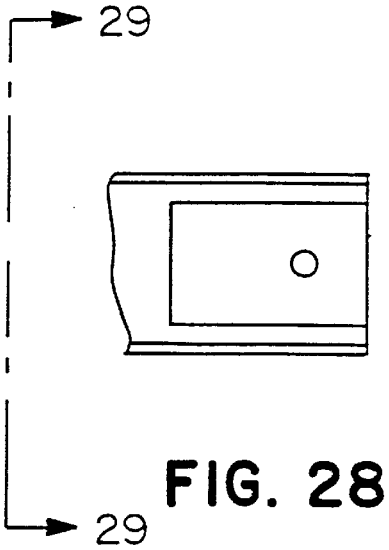
FIG. 28 is a side elevation of the other end of the trolley assembly of FIG. 18 and, again, enlarged in scale and detailed.
Figure 29:
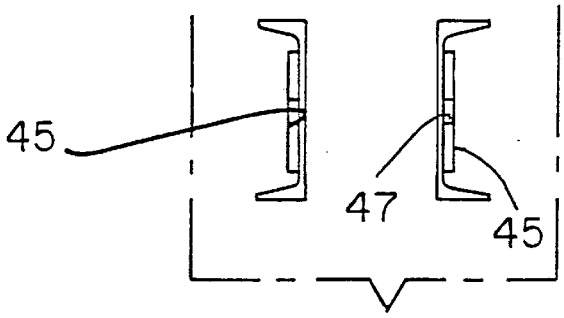
FIG. 29 is a detailed view thereof, taken along the lines 29—29 of FIG. 28.
Figure 30:
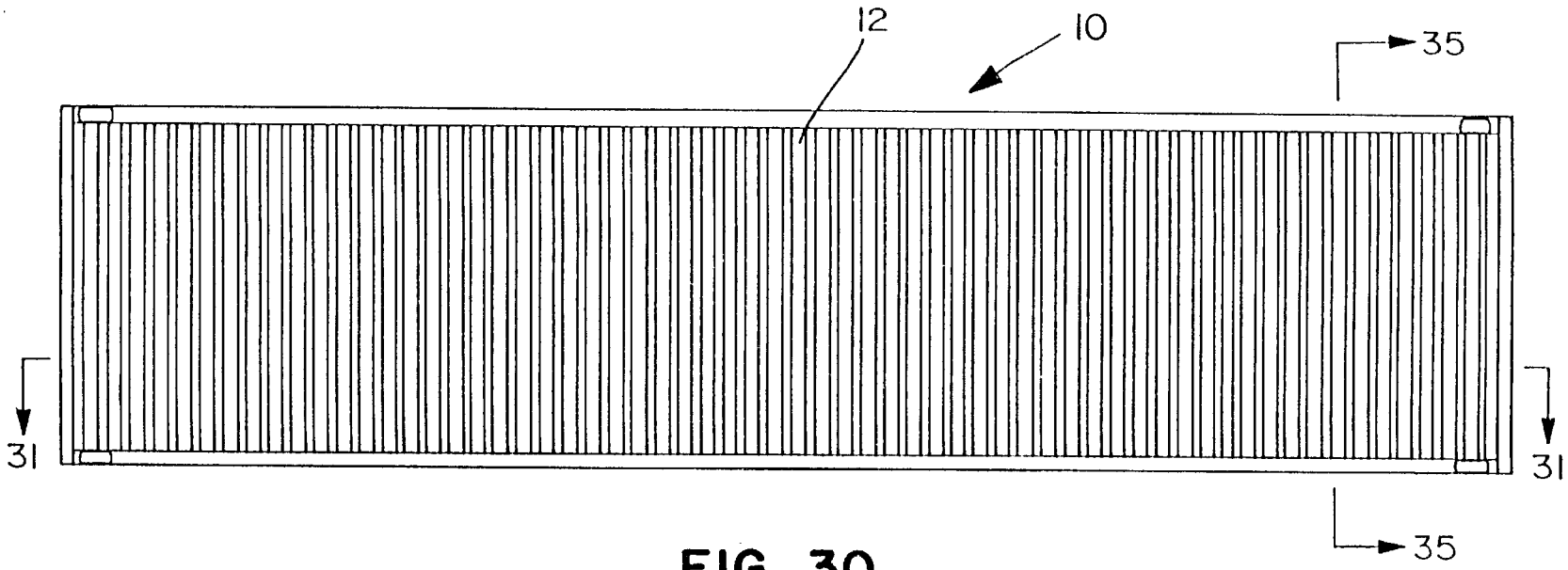
FIG. 30 is a bottom view of the roof panel.
Figure 31:
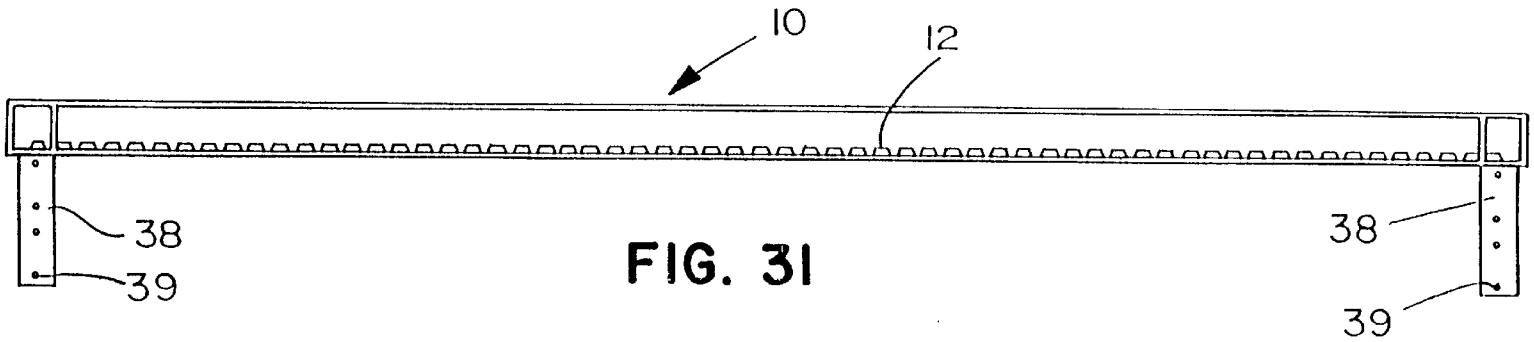
FIG. 31 is a longitudinal section view thereof, taken along the lines 31—31 of FIG.30.
Figure 32:
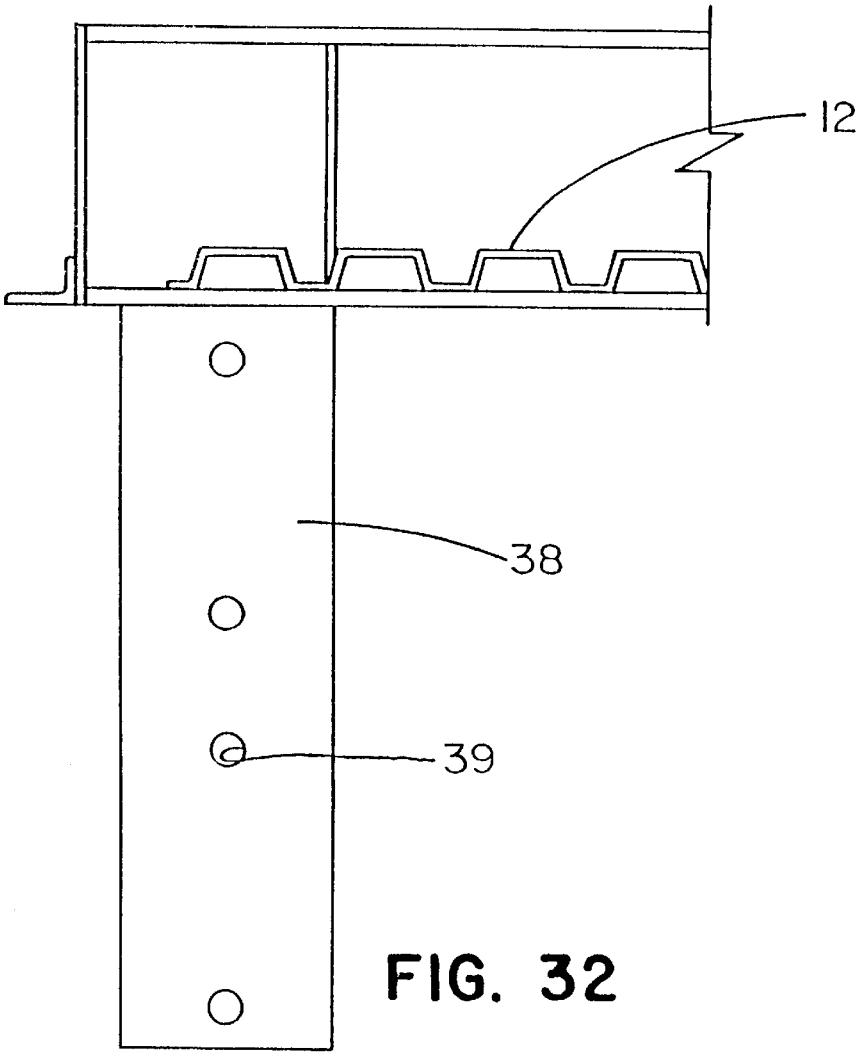
FIG. 32 is a detail view of one embodiment of the roof panel, drawn to an enlarged scale.
Figure 34:
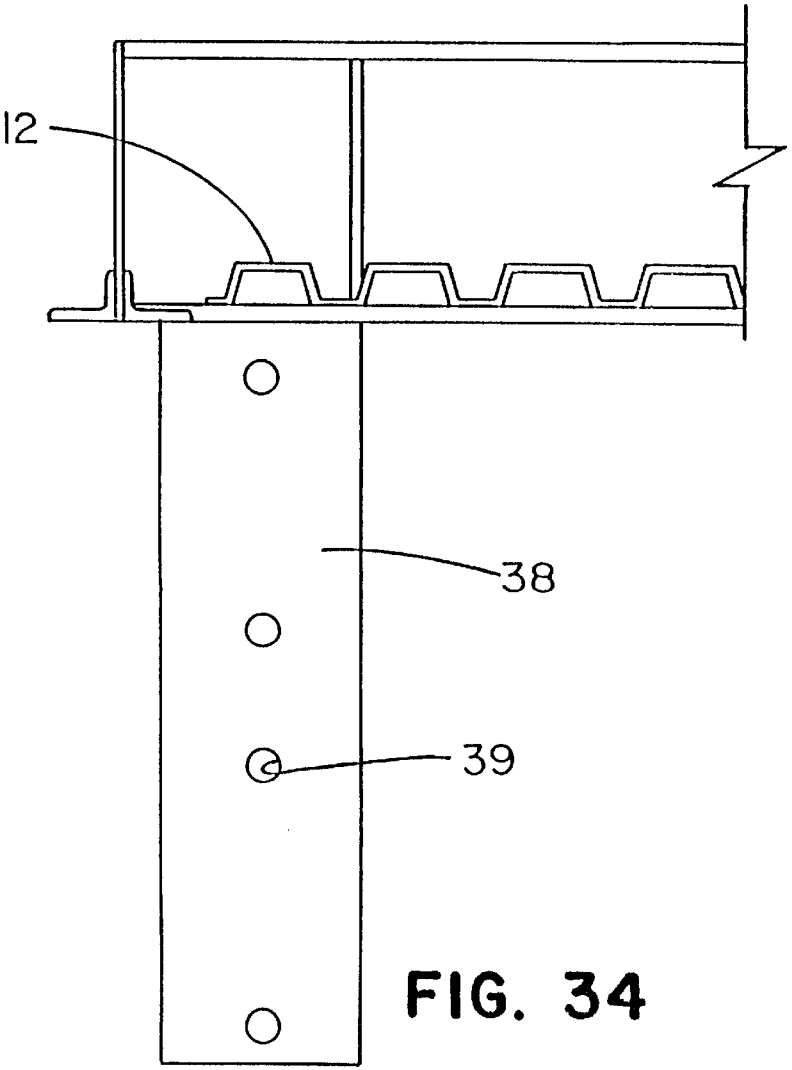
FIG. 34 is a detail view of a second embodiment of the roof panel, drawn to an enlarged scale.
Figure 33:
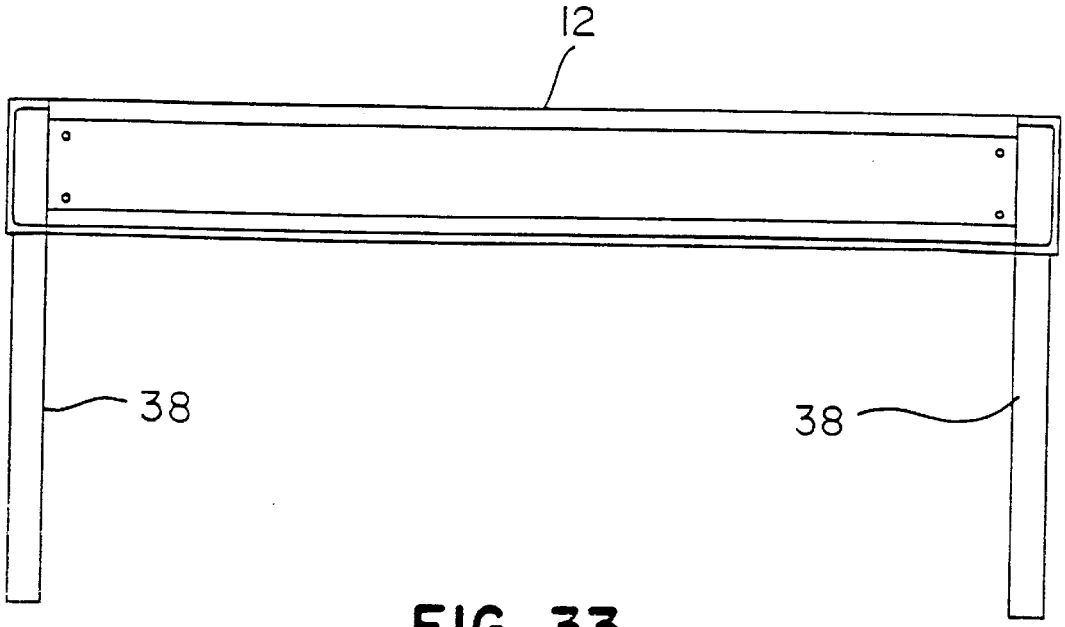
FIG. 33 is an end view of the one embodiment of the roof panel; the panel is provided with connection tubes that fit inside the respective columns.
Figure 35:
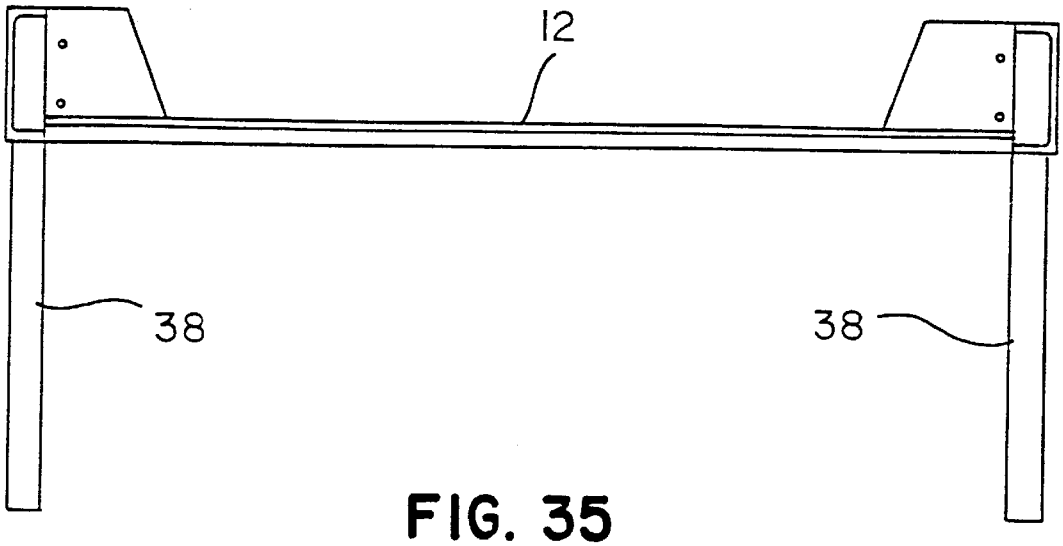
FIG. 35 is an end view of the second embodiment of the roof panel; and again, the panel is provided with connection tubes that fit inside the respective columns.

In the preferred embodiment of the present invention, the movable safety tunnel MT is one hundred and ninety-eight (198) feet long, and is divided into six (6) sections, each of which is thirty-three (33) feet long. Each section is raised by a crane and lifted in place. In one practical application, the bridge B is over water; and the respective sections of the safety tunnel MT are transported by a barge. One end of each section of the safety tunnel MT has a pair of tongues 44 (see FIG. 26) which cooperate with a pair of plates 45 (see FIG. 27). Holes 46 in the tongues 44 are aligned with holes 47 in the plates 45, and a pin or bolt (not shown) is received in these aligned holes, thereby assembling the respective sections together to form the complete safety tunnel MT.

Moreover, in the practical application, the portion of bridge B being maintained is approximately eighteen hundred (1800) feet long. In that application, the rails 16 are constructed along approximately five hundred (500) feet at one end of that portion of the bridge B. When the maintenance work is completed on length L of the bridge B, the safety tunnel MT is moved to the remaining length of the rails 16 on the bridge B, and then the rails 16 are taken up in a "leapfrog" fashion, section by section, and re-installed ahead of the safety tunnel MT and so on until the maintenance work on the complete length of the bridge B has been completed. A forklift truck (or other suitable equipment) moves the safety tunnel MT into its next position.

Only one lane of the bridge B may be closed off to re-install the rail 16.

All of the components and/or materials of the movable tunnel MT of the present invention are readily available on the market, and the assembly thereof is relatively quick and convenient. Moreover, it will be appreciated by those skilled in the art that the dimensions of the various components disclosed herein are not for purposes of limitation but, rather, for purposes of making a complete disclosure to facilitate a review of the present invention by one skilled in the art and a ready appreciation of the features and advantages of the invention.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. In the method of maintaining a bridge, wherein the bridge has a roadway having a usable given width defined by spaced-apart raised parapets, the improvement wherein the normal traffic may flow along the bridge or under the bridge while the maintenance is being performed on the bridge, comprising the steps of providing a movable safety tunnel riding on rails mounted on top of the respective parapets, and moving the safety tunnel along the rails on the respective parapets on the bridge as the maintenance on the bridge progresses along the length of the bridge, wherein the movable safety tunnel has an interior width which is equal to or greater than the usable given width of the roadway, thereby minimizing any interference with the normal traffic flow on the bridge.

2. The method of claim 1, wherein the bridge has a roadway, and wherein the movable safety tunnel comprises an inverted U-shaped structure which cooperates with the roadway to form an enclosure for the traffic flow.

3. The method of claim 1, further including the steps of locking the movable safety tunnel to a first section of the bridge, performing the maintenance on that first section of the bridge, unlocking the movable safety tunnel and moving it to a second section of the bridge, locking the movable safety tunnel to that second section of the bridge, and performing the maintenance thereon.

4. A movable safety tunnel for bridge maintenance and repair, wherein the bridge has a roadway, the width of which is defined by spaced-apart raised parapets, one on each side of the roadway, the movable safety tunnel including a plurality of spaced-apart upstanding posts on either side thereof, panels connected to the upstanding posts and providing respective sides of the tunnel, and a roof having a plurality of spaced-apart members connected to the upstanding posts, thereby forming an inverted U-shaped structure, a plurality of spaced-apart wheels carried by the U-shaped structure and guided for movement on top of the parapets longitudinally thereof, whereby the usable width of the roadway on the bridge is not substantially impaired, thereby facilitating substantially uninterrupted traffic flow on the bridge while the maintenance or repair is being performed, and thereby assuring the safety of the workers and the traffic flow, and the movable safety tunnel being selectively locked and unlocked against movement longitudinally on bridge, such that the movable safety tunnel may be locked while the maintenance or repair is being performed, and such that the movable safety tunnel may be unlocked and moved longitudinally on bridge into the next position of the movable safety tunnel and then locked in place, thereby avoiding costly shutdowns due to repeated assembly and disassembly of the safety tunnel.

5. The movable safety tunnel of claim 4, wherein rails are mounted on top of the respective parapets, and wherein the plurality of spaced-apart wheels ride on the rails.

6. The movable safety tunnel of claim 5, wherein the wheels straddle the respective rails.

7. The movable safety tunnel of claim 4, wherein the spaced-apart members depend from the roof and are adjustably connected to the upstanding posts.

* * * * *